United States Patent [19]

Hoeft et al.

[11] 4,251,703

[45] Feb. 17, 1981

[54] PUSHBUTTON FOR USE WITH PUSHBUTTON SWITCHES

[75] Inventors: Siegfried Hoeft, Ditzingen; Gerhard Klause, Renningen, both of Fed. Rep. of Germany

[73] Assignee: International Standard Electric Corporation, New York, N.Y.

[21] Appl. No.: 88,258

[22] Filed: Oct. 25, 1979

[30] Foreign Application Priority Data

Nov. 10, 1978 [DE] Fed. Rep. of Germany ..... 2848741

[51] Int. Cl.[3] ..... H01H 3/12

[52] U.S. Cl. ..... 200/340

[58] Field of Search ..... 200/159 R, 159 A, 159 B, 200/340, 5 A, 330

[56] References Cited

U.S. PATENT DOCUMENTS

| | | | |
|---|---|---|---|
| 2,480,336 | 8/1949 | Orme | 200/159 R |
| 3,367,206 | 2/1968 | Moody | 200/340 |
| 3,773,998 | 11/1973 | Seeger, Jr. et al. | 200/330 |
| 3,895,205 | 7/1975 | Tharp | 200/340 |
| 3,899,648 | 8/1975 | Murata | 200/5 A |

FOREIGN PATENT DOCUMENTS

| | | | |
|---|---|---|---|
| 1243754 | 7/1967 | Fed. Rep. of Germany | 200/330 |
| 1078374 | 8/1967 | United Kingdom | 200/340 |
| 1503662 | 3/1978 | United Kingdom | 200/330 |

*Primary Examiner*—John W. Shepperd

*Attorney, Agent, or Firm*—John T. O'Halloran; Jeffrey P. Morris

[57] ABSTRACT

For physically disabled persons suffering from a disturbed coordination of movements it is necessary for the operating keys of e.g., telephone subsets, to be made variable with respect to the operating pressure. For this purpose the push-button head is designed in such a way that additional compression springs can be inserted or removed from above.

16 Claims, 3 Drawing Figures

PUSHBUTTON FOR USE WITH PUSHBUTTON SWITCHES

The present invention relates to a pushbutton for use with pushbutton switches as set forth in the preamble of claim 1.

From the German Auslegeschrift (DF-AS) No. 1,263,894 there is already known a pushbutton switch whose pushbutton, with the aid of two resilient snap-on hooks moulded thereto, is capable of locking behind oppositely directed hooks of the same kind arranged on a mounting board. In the snap-on state, this simultaneously defines the normal position of the pushbutton switch, into which it is brought by the action of the reset spring.

It is the object of the invention to provide a pushbutton as set forth in the preamble of claim 1, for use with commercial types of pushbutton switches, by which it is made possible to vary the resetting force of the pushbutton switch acting in opposition to the compressive force. This object is achieved by the features set forth in the characterizing part of claim 1. Advantageous further embodiments are set forth in the subclaims. The construction according to the invention permits, if so required, by unlatching the latch member, to insert a further energy-storing device, such as a compression spring, into the pushbutton, with the force thereof being added to that of the energy-storing device as already provided for inside the pushbutton switch. Both the unlatching and reinsertion of the latch member can be carried out in a simple way, e.g. with the aid of a coin, without the pushbutton itself or even the pushbutton switch having to be demounted. The top side of the pushbutton can be closed in an elegant way by a cap which, if made of a transparent material, in addition thereto permits the insertion of an inscription or a label carrying symbols. The invention offers a particular advantage above all in cases where the resetting force of pushbutton switches is to be adapted in a more or less strong way to the requirements of the disabled. This necessity arises above all in hospitals where the resetting forces of calling and pushbutton dialling arrangements have to be changed frequently during relatively short periods of time.

Figure 2:
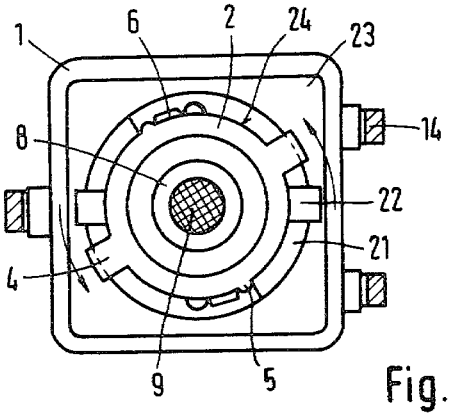
Figure 1:
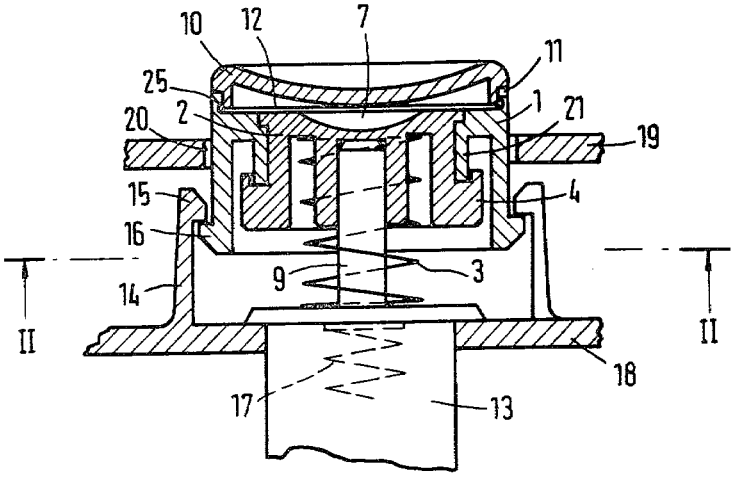
Figure 3:
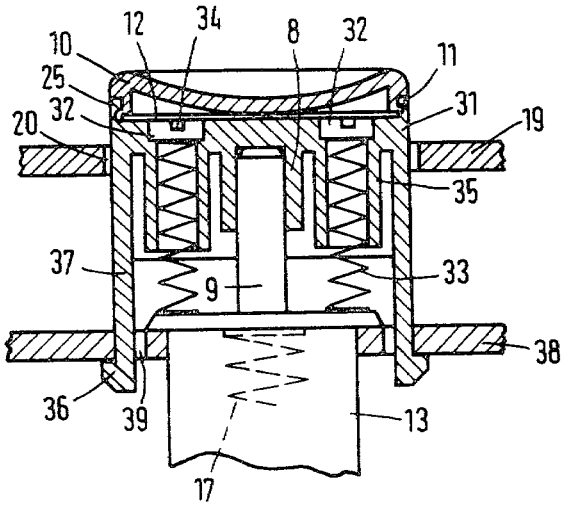

The invention will now be explained in greater detail with reference to examples of embodiment shown in FIGS. 1 to 3 of the accompanying drawings, in which:

FIG. 1 is a longitudinal section taken through a pushbutton according to the invention, in its assembled state, FIG. 2 is a cross sectional view taken on line II—II of FIG. 1, and FIG. 3 shows a modified type of pushbutton, in a longitudinal section.

The pushbutton 1 as shown in FIGS. 1 and 2, has a substantially square shaped outline. On the outside, two or three snap-on detents 16 are moulded near the bottom edge of the pushbutton which is appropriately made of a plastics material. When placed on to the pushbutton switch 13, these snap-on detents 16 engage behind oppositely directed snap-on detents 15 provided for on resilient snap-on hooks 14 moulded to the mounting board 18 in a standing up direction, with the pushbutton switch 13 being mounted to the same mounting board 18. The entire arrangement is appropriately covered by a cover plate 19 provided with a corresponding opening 20 through which the pushbutton 1 is permitted to project.

The pushbutton 1 is open at its bottom, and substantially hollow inside, but is provided in its upper wall 23 with a circular recess 24 which is followed by a tubular extension 21. In this recess 24 or the extension 21, the cylindrical latch member 2 is capable of being inserted from above, with this latch member then capable of being connected to the pushbutton 1 by means of a bayonet catch. For the bayonet catch members 4 of the latch member 2, corresponding enlargements 22 are provided for in the recess 24 of the pushbutton, which permit the insertion. The bayonet catch members 4 may be undercut (FIG. 1) in order thus to improve both the centering and the friction.

Moreover, engaging cams 5 may be provided for along the circumference of the latch member 2, which snap behind the freely cut out resilient tabs 6 of the pushbutton when the latch member 2 is turned in the direction as indicated by the arrow (FIG. 2). This reliably prevents a loosening on its own. For the intended turning (latching or unlatching), a segment-shaped slot 7 is provided for on the top side of the latch member 2, in which a coin may be inserted for serving as a tool.

The latch member 2 is a hollow cylinder closed at its top end, containing a tubular extension 8 moulded to the face wall. This extension has two different functions: In the inside it takes up the actuating push rod (plunger) 9 of the pushbutton switch 13 while a helical compression spring 3 may be slipped over its outer surface. This spring 3 which is dimensioned in accordance with the required values, assists in its effect the force of the energy storing device 17 as already built into the commercially available type of pushbutton switch 13.

On its upper side, the pushbutton 1 is topped by the cap 10 providing the pushbutton with an appropriate cover. When made of a non-transparent material, the inherent properties of the pushbutton cannot be recognized so easily by unauthorized persons. When made of a transparent material, an inscription label 12 may be inserted therein, bearing symbols or characters. The top side of the pushbutton is somewhat deepened, and the correspondingly shaped cap 10 fits tightly into the marginal rim portion 25, so as to be flush on the outside. In order to be able to remove easily the cap 10 which, e.g., snaps on with a flat bead, a small recess 11 is provided for at the upper edge of the pushbutton 1, which may be engaged, e.g. by a finger nail.

FIG. 3 shows a modified embodiment o the pushbutton employing two additional helical compression springs. In its outer appearance, this pushbutton resembles the pushbutton 1 described hereinbefore with reference to FIGS. 1 and 2, so that partly identical parts have been indicated by the same reference numerals. In this case, however, the snap-on detents 36 form part of resilient snap-on hooks 37 which, at the lower edge of the pushbutton 31, in extension of its side walls, project to such an extent as to engage behind the mounting board 38. The latter is provided with recesses 39 permitting the passage of the snap-on hooks 37. For this reason, the moulded-on snap-on hooks 14 (FIG. 1) may be omitted. In its inside, the pushbutton 31 is missing the central latch member. Instead of this, on the face wall of the pushbuttom 31 and symmetrically in relation to the centre, two tubular extensions 35 with a throughgoing bore are moulded thereto, each serving to receive one helical compression spring 33. On the top side of the pushbutton 31, the bores for the springs 33 are somewhat enlarged and closed by fitting latch member 32 which are either snapped in or locked in position by a bayonet catch. For the purpose of being actuated, they are each provided with a slot 34.

Instead of the rectangular outline, the pushbuttons 1 and 31 may also have a circular outline. The snap-on hooks 14 or 37 are then either arranged diagonally or, in cases where more than two are employed, disposed along the circumference in accordance with requirements.

In the place of use, the compression springs or 33 are either inserted or replaced in accordance with requirements. For example, they may be put at the disposal of the hospital's therapist who, in taking care of physically disabled persons suffering from a disturbed coordination of movements, may insert them into the equipment to be operated by the disabled, such as telephone substation sets or the devices for controlling the opening and closing of windows, roller blindes, etc. These physically disabled persons are incapable of properly actuating normal types of operating keys (operating force approximately 50 to 100 cN), as it already causes great trouble to them to properly position the finger on the pushbutton, normally resulting in sweeping contact actuations. By correspondingly consulting the additional springs 3 or 33, the operating force can be increased to such as extent (up to a maximum of about 20 N), that faulty actuations can be extensively avoided.

What is claimed is:

1. A pushbutton for a pushbutton switch comprising an actuating push rod; an energy-storing device for resetting, said pushbutton being held enagagingly in position with detent members moulded thereto to provide a resetting position; and wherein said pushbutton includes at least one latch member insertable from the top side such that space is provided below said latch member for receiving a second energy-storing device, said pushbutton further including a hole therethrough for receiving said second energy-storing device from above said switch without removing said pushbutton, said second energy-storing device being compressed and retained by said latch member and supported by said pushbutton switch.

2. A pushbutton as claimed in claim 1, wherein said latch member is of cylindrical configuration and is connected to said pushbutton with a bayonet catch means.

3. A pushbutton as claimed in claim 2, wherein said bayonet catch means is undercut at said latch member.

4. A pushbutton as claimed in claim 3, further comprising at least one engaging cam on said latch member, capable of engaging behind a freely cut out tab of said pushbutton.

5. A pushbutton as claimed in claim 4, wherein in the top side of said latch member there is provided a slot for permitting actuation of said latch member.

6. A pushbutton as claimed in claim 1, wherein said energy-storing device comprises a helical spring.

7. A pushbutton as claimed in claim 6, wherein said helical spring is retained by an extension means.

8. A pushbutton as claimed in claim 7, wherein said extension means is of tubular design.

9. A pushbutton as claimed in claim 8, wherein said tubular extension means also receives the actuating push rod of said pushbutton switch.

10. A pushbutton as claimed in claim 1, wherein the top side thereof further includes a snap-on type cap.

11. A pushbutton as claimed in claim 10, further including a small recess at the upper edge for loosening said cap.

12. A pushbutton as claimed in claim 11, wherein said cap is comprised of transparent material for covering an inscription label.

13. A pushbutton as claimed in claim 12, wherein said pushbutton is rectangular in outline.

14. A pushbutton as claimed in claim 12, wherein said pushbutton is circular in outline.

15. A pushbutton as claimed in claim 1, further comprising snap-on detents moulded to the outside near the bottom edge of said pushbutton, and engaging behind resilient hooks moulded to a mounting board in a standing up position.

16. A pushbutton as claimed in claim 15, wherein said snap-on detents form part of snap-on hooks projecting from the lower edge of said pushbutton, and engage behind correspondning recesses provided for in said mounting board.

* * * * *